US007364629B2

(12) United States Patent
Ushigami et al.

(10) Patent No.: US 7,364,629 B2
(45) Date of Patent: Apr. 29, 2008

(54) METHOD FOR MANUFACTURING GRAIN-ORIENTED SILICON STEEL SHEETS WITH MIRROR-LIKE SURFACE

(75) Inventors: Yoshiyuki Ushigami, Futtsu (JP); Shuichi Nakamura, Futtsu (JP); Hiroyasu Fujii, Kitakyushu (JP); Kenichi Murakami, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 499 days.

(21) Appl. No.: 10/500,994

(22) PCT Filed: Jan. 7, 2003

(86) PCT No.: PCT/JP03/00043

§ 371 (c)(1),
(2), (4) Date: Jan. 12, 2005

(87) PCT Pub. No.: WO03/057929

PCT Pub. Date: Jul. 17, 2003

(65) Prior Publication Data

US 2005/0217761 A1 Oct. 6, 2005

(30) Foreign Application Priority Data

Jan. 8, 2002 (JP) ..... 2002-001604
Sep. 20, 2002 (JP) ..... 2002-275777

(51) Int. Cl.
*H01F 1/147* (2006.01)
*H01F 1/18* (2006.01)

(52) U.S. Cl. ..... 148/113; 148/110; 148/111

(58) Field of Classification Search ..... None
See application file for complete search history.

(56) References Cited

U.S. PATENT DOCUMENTS 3,785,882 A 1/1974 Jackson
6,613,160 B2 * 9/2003 Ushigami et al. ..... 148/113

FOREIGN PATENT DOCUMENTS

| | | | |
|---|---|---|---|
| EP | 0607440 | A1 | 7/1994 |
| EP | 0753588 | A1 | 1/1997 |
| JP | 58-26405 | B | 6/1983 |
| JP | 62-45285 | B | 9/1987 |
| JP | 64-83620 | A | 3/1989 |
| JP | 6-136448 | * | 5/1994 |
| JP | 6-256848 | A | 9/1994 |
| JP | 7-118749 | A | 5/1995 |
| JP | 8-269558 | * | 10/1996 |
| JP | 8-269559 | * | 10/1996 |
| JP | 9-78253 | A | 3/1997 |
| JP | 2002-212623 | A | 7/2002 |

OTHER PUBLICATIONS

Machine Translation of Japanese Patent Document No. 08-269558.*
JP 56-51522 A, Patent Abstracts of Japan, May 9, 1981.
JP 62-40315 A, Patent Abstracts of Japan, Feb. 21, 1987.
Shigeru Suzuki et al., "Fe-3% Si Gokin no Saikessho Kyodo ni Taisuru Sn Tenka Koka", Current Advances in Materials and Processes, Sep. 1999, vol. 12, No. 6, p. 1273 (with English translation).

* cited by examiner

*Primary Examiner*—John P. Sheehan
(74) *Attorney, Agent, or Firm*—Kenyon & Kenyon LLP

(57) ABSTRACT

In a method for manufacturing grain-oriented silicon steel with mirror-like surface by applying an aqueous slurry of an annealing separator, magnetic properties are stabilized by controlling the amount of moisture, carried in the annealing separator consisting mainly of alumina after application and drying thereof, to not more than 1.5%, controlling the partial water vapor pressure during finish-annealing and eliminating the variation (instability) in secondary recrystallization caused by the inhibitor reaction at the interface.

8 Claims, 4 Drawing Sheets

METHOD FOR MANUFACTURING GRAIN-ORIENTED SILICON STEEL SHEETS WITH MIRROR-LIKE SURFACE

TECHNICAL FIELD

This invention mainly relates to methods for manufacturing grain-oriented silicon steel sheets used mainly as iron cores of transformers and other electric appliances and, more particularly, to improving the iron loss properties thereof by finishing the surface thereof effectively.

BACKGROUND ART

Grain-oriented silicon steel sheets are used as magnetic cores of various electric appliances. Grain-oriented silicon steel sheets are steel sheets, containing Si at 0.8% to 4.8%, which have crystal grains highly oriented in the {110}<001> direction. The required magnetic properties are high magnetic flux densities (represented by the value of B8) and low iron losses (represented by the value of W17/50). Recently, due to an increasing concern for energy conservation, particularly, the demand for lower power losses is increasing.

To meet these requirements, technologies to finely divide magnetic domains have been developed as means for decreasing iron losses of grain-oriented silicon steel sheets.

In a case of producing stacked iron cores, Japanese Examined Patent Publication (Koukoku) No. 58-26405, for example, discloses a method for decreasing iron losses by finely dividing magnetic domains by localized strains which are introduced by irradiating laser beams onto finish-annealed sheets.

Observation of the movement of the finely divided magnetic domains, however, revealed that some of magnetic domains are pinned and made stationary by the asperity of the glass coating on the surface of steel sheets. In order to further decrease iron losses of grain-oriented electrical steel sheets, therefore, it is considered important to diminish the pinning effect caused by the asperity of the glass coating on the surface of steel sheets that hampers the motion thereof, in addition to fine dividing of magnetic domains.

Not forming a glass coating that hampers the motion of magnetic domains, on the surface of steel sheets, is considered effective. The specification of the U.S. Pat. No. 3,785,882, for example, discloses a method not forming glass coating and using coarse high-purity alumina as an annealing separator. As, however, this method cannot eliminate inclusions existing immediately below the surface, the improvement in iron loss remains not more than 2% in terms of W15/60 because of the pinning effect of such inclusions.

Japanese Unexamined Patent Publication (Kokai) No. 64-83620, for example, discloses a method of applying chemical or electrolytic polishing, after finish-annealing, as means for holding back the production of inclusions immediately below the surface and providing smooth (mirror-like) surfaces. Chemical and electrolytic polishing, however, have been possible only in processing small specimens on a laboratory scale. They have not been used practically because there are difficult problems in control of chemicals' concentration and temperature and in the provision of pollution control equipment.

To solve the above problems, the inventors made various experiments and found that control of the dew point of decarburized-annealing and prevention of the formation of Fe-based oxides (such as $Fe_2SiO_4$ and FeO) in the oxidized layer formed in the course of decarburized-annealing are effective for elimination of surface inclusions (refer to Japanese Unexamined Patent Publication (Kokai) No. 7-118749).

Application of an aqueous slurry, or dry coating by electrostatic or other methods, of an annealing separator consisting mainly of alumina on decarburized-annealed sheets having an oxidized layer provides a mirror-like surface after finish-annealing and thereby greatly decreases iron losses.

SUMMARY OF THE INVENTION

Application of an aqueous slurry of an annealing separator can be implemented by using simpler equipment than required dry coating by electrostatic or other methods. However, it was found that application of an aqueous slurry of an annealing separator consisting mainly of alumina sometimes makes secondary recrystallization unstable.

The object of this invention is to provide a method of achieving stable secondary recrystallization by removing the cause of unstable secondary recrystallization.

By making various experiments to solve the above problem, the inventors found that stable secondary recrystallization can be achieved by controlling the amount of moisture carried in an aqueous slurry of an annealing separator consisting mainly of alumina after application and drying and the partial water vapor pressure during finish-annealing.

To be more specific, control of the partial water vapor pressure during finish-annealing means that a degree of oxidation ($PH_2O/PH_2$) is maintained between not lower than 0.0001 and not higher than 0.2 when the finish-annealing atmosphere contains hydrogen and a dew point is controlled to be not higher than 0° C. when the finish-annealing atmosphere is an inert gas not containing hydrogen.

In addition, the moisture carried means the moisture carried into the annealing separator as water of hydration or water of crystallization. As the moisture carried into the annealing separator in these forms decomposes and disappears when the annealing temperature reaches 1000° C., the amount of moisture carried is practically determined as the loss of mass after application, drying and annealing to 1000° C.

Details of the invention are described below.

The inventors investigated the cause that makes secondary recrystallization vary even when the decarburized-annealed sheets prepared by the method disclosed in Japanese Unexamined Patent Publication (Kokai) No. 7-118749. The investigation led to a discovery that the amount of moisture after an aqueous slurry of an annealing separator consisting mainly of alumina has been applied and dried and the degree of oxidation of the atmosphere gas during finish-annealing greatly affect the behavior of secondary recrystallization.

A silicon steel slab containing Si of 3.3 mass %, Mn of 0.1 mass %, C of 0.06 mass %, S of 0.007 mass %, acid-soluble Al of 0.028 mass %, and N of 0.008 mass % was heated to 1150° C. and then hot-rolled to a thickness of 2.0 mm. The hot-rolled sheet was annealed at 1120° C. for 2 minutes and then cold-rolled to a final thickness of 0.22 mm. The cold-rolled sheet was decarburized-annealed in a wet gas with a degree of oxidation ($PH_2O/PH_2$) of 0.01 at 830° C.

Several slurries of aluminas were prepared by stirring them in water at 0° C. to 50° C. and the obtained slurries were applied and dried on specimens. Portions of the applied and dried aluminas were taken and heated to 1000° C. and the amounts of moisture contained were determined from the loss of their masses.

The specimens were layered and finish-annealed. Finish-annealing was implemented in a mixed atmosphere of nitrogen and hydrogen with a degree of oxidation ($PH_2O/PH_2$) of 0.00016 to 1200° C. at a rate of 10° C./hour and then at 1200° C. for 5 hours in a hydrogen gas with a degree of oxidation ($PH_2O/PH_2$) of 0.000039.

FIG. 1 shows the magnetic flux densities (B8) after annealing. FIG. 1 indicates that secondary recrystallization became unstable and the magnetic flux density (B8) of the specimens deteriorated when the amount of moisture after application and drying exceeds 1.5%.

It is presumed that, when the amount of moisture after application and drying is large, the moisture is released during annealing and oxidation of Al accelerates the decomposition of such inhibitors as AlN and (Al, Si)N. Therefore, the amount of moisture in the annealing separator after application and drying should be not more than 1.5%, or preferably not more than 1%.

Based on the result described above, as it is considered that the amount of moisture in the annealing separator, after application and drying, affects the behavior of secondary recrystallization via the degree of oxidation of the atmosphere at the surface of the steel sheet being finish-annealed, the influence of the degree of oxidation of the atmosphere gas was then investigated. Specimens prepared by applying an annealing separator containing 0.5% of moisture after application and drying on said decarburized-annealed sheet were layered and the influence of the degree of oxidation ($PH_2O/PH_2$) of the atmosphere gas during finish-annealing was investigated by varying the ratio of nitrogen to hydrogen and the partial water vapor pressure.

FIG. 2 shows the influence of the degree of oxidation of the atmosphere gas during finish-annealing on the magnetic flux density (B8) of the specimen after annealing. FIG. 2 shows that secondary recrystallization is stable and magnetic flux density (B8) is high when the degree of oxidation ($PH_2O/PH_2$) is between not lower than 0.0001 and not higher than 0.2.

It is presumed that, when the degree of oxidation ($PH_2O/PH_2$) is under 0.0001, the dense film of silica formed by decarburized-annealing is reduced before the completion of secondary recrystallization during finish-annealing and, therefore, becomes unable to check the decomposition of such inhibitors as AlN and (Al, Si)N caused by the gasification of nitrogen in steel.

It is also presumed that, when the degree of oxidation ($PH_2O/PH_2$) is 0.2 or above, the degree of oxidation of the atmosphere at the surface of the steel sheet is high and the oxidation of Al accelerates the decomposition of such inhibitors as AlN and (Al, Si)N.

While the foregoing are the cases in which the finish-annealing atmosphere contains hydrogen, studies on the atmosphere not containing hydrogen revealed that the amount of moisture in the aqueous slurry of the annealing separator consisting mainly of alumina, after application and drying, and the dew point of the atmosphere during finish-annealing, greatly vary the secondary recrystallization behavior.

A silicon steel slab containing Si of 3.3 mass %, Mn of 0.1 mass %, C of 0.06 mass %, S of 0.007 mass %, acid-soluble Al of 0.028 mass %, and N of 0.008 mass % was heated to 1150° C. and then hot-rolled to a thickness of 2.0 mm. The hot-rolled sheet was annealed at 1120° C. for 2 minutes and then cold-rolled to a final thickness of 0.22 mm. The cold-rolled sheet was decarburized-annealed in a wet gas with a degree of oxidation ($PH_2O/PH_2$) of 0.01 at 830° C.

Several slurries of aluminas were prepared by stirring them in water at 0° C. to 50° C. and the obtained slurries were applied and dried on specimens. Portions of the applied and dried aluminas were taken and heated to 1000° C. and the amounts of moisture contained were determined from the loss of their masses.

The specimens were layered and finish-annealed. Finish-annealing was implemented by heating to 1200° C. at a rate of 10° C./hour in a nitrogen gas atmosphere whose dew point is −50° C. and then at 1200° C. for 5 hours in a hydrogen gas whose dew point is −50° C.

FIG. 3 shows the magnetic flux densities (B8) after annealing. FIG. 3 shows that secondary recrystallization became unstable and the magnetic flux density (B8) of the specimens deteriorated when the amount of moisture after application and drying exceeds 1.5%.

It is presumed that when the amount of moisture after application and drying is large, the moisture is released during annealing and oxidation of Al accelerates the decomposition of such inhibitors as AlN and (Al, Si)N. Therefore, the amount of moisture in the annealing separator after application and drying should be not more than 1.5%, or preferably not more than 1%.

As the result described above indicates that the amount of moisture in the annealing separator after application and drying affects the behavior of secondary recrystallization via the dew point of the atmosphere at the surface of the steel sheet being finish-annealed, the influence of the dew point of the atmosphere was then investigated. Specimens prepared by applying an annealing separator containing 0.5% of moisture after application and drying on said decarburized-annealed sheet were layered and the influence of the dew point of the nitrogen gas during finish-annealing was investigated.

FIG. 4 shows the influence of the dew point of the nitrogen atmosphere gas during finish-annealing on the magnetic flux density (B8) of the specimen after annealing. FIG. 4 shows that secondary recrystallization is stable and magnetic flux density (B8) is high when the dew point is not higher than 0° C.

It is presumed that, when the dew point is higher than 0° C., the dew point of the atmosphere at the surface of the steel sheet is high and the oxidation of Al accelerates the decomposition of such inhibitors as AlN and (Al, Si)N.

The present invention is based on the findings described above and the gist of the invention is as given below.

(1) A method for manufacturing grain-oriented silicon steel sheet with mirror-like surface having high magnetic flux density, comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, with the remainder substantially comprising Fe and unavoidable impurities, reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides and, providing a mirror-like surface by finish-annealing the steel sheet applied by an annealing separator consisting mainly of alumina, the method for manufacturing grain-oriented silicon steel sheet with mirror-like surface being characterized by, stabilizing secondary recrystallization by controlling the amount of moisture carried in the annealing separator consisting mainly of alumina after application and drying thereof, and the partial water vapor pressure during finish-annealing.

(2) A method for manufacturing grain-oriented silicon steel sheet with mirror-like surface having good iron loss properties, comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, with the remainder substantially comprising Fe and unavoidable impurities after heating the slab at a temperature not higher than 1280° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, applying a nitriding treatment and, providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and, injecting an atmosphere gas having a degree of oxidation ($PH_2O/PH_2$) of not lower than 0.0001 and not higher than 0.2 during finish-annealing.

(3) A method for manufacturing grain-oriented silicon steel sheet with mirror-like surface having good iron loss properties, comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, Mn of 0.03 mass % to 0.15 mass %, S of 0.01 mass % to 0.05 mass %, with the remainder substantially comprising Fe and unavoidable impurities after heating the slab at a temperature not lower than 1320° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and injecting an atmosphere gas having a degree of oxidation ($PH_2O/PH_2$) of not lower than 0.0001 and not higher than 0.2 during finish-annealing.

(4) The method for manufacturing grain-oriented silicon steel sheet with mirror-like surface having good iron loss properties according to (2) or (3), characterized by, injecting an atmosphere gas having a degree of oxidation ($PH_2O/PH_2$) of not lower than 0.0001 and not higher than 0.2 into a temperature zone of 600° C. to 1100° C. during said finish-annealing.

(5) The method for manufacturing grain-oriented silicon steel sheet with mirror-like surface having good iron loss properties according to (2), (3) or (4), characterized by, adding Sn or Sb of 0.03 mass % to 0.15 mass % to said steel.

(6) A method for manufacturing grain-oriented silicon steel sheet with mirror-like surface having good iron loss properties comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, with the remainder substantially comprising Fe and unavoidable impurities after heating the slab at a temperature not higher than 1280° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, applying a nitriding treatment and providing a mirror-like surface by the finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and injecting an inert gas having a dew point of not higher than 0° C. as the atmosphere gas during finish-annealing.

(7) A method for manufacturing grain-oriented silicon steel sheet with mirror-like surface having good iron loss properties comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, Mn of 0.03 mass % to 0.15 mass %, S of 0.01 mass % to 0.05 mass %, with the remainder substantially comprising Fe and unavoidable impurities after heating the slab at a temperature not lower than 1320° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and injecting an inert gas having a dew point of not higher than 0° C. as the atmosphere gas during finish-annealing.

(8) The method for manufacturing grain-oriented silicon steel sheet with mirror-like surface having good iron loss properties according to (6) or (7), characterized by, injecting an inert gas having a dew point of not higher than 0° C. as the atmosphere gas into a temperature zone of 600° C. to 1100° C. during said finish-annealing.

(9) The method for manufacturing grain-oriented silicon steel sheet with mirror-like surface having good iron loss properties according to (6), (7) or (8), characterized by, adding Sn or Sb of 0.03 mass % to 0.15 mass % to said steel.

THE MOST PREFERRED EMBODIMENTS

Figure 1:
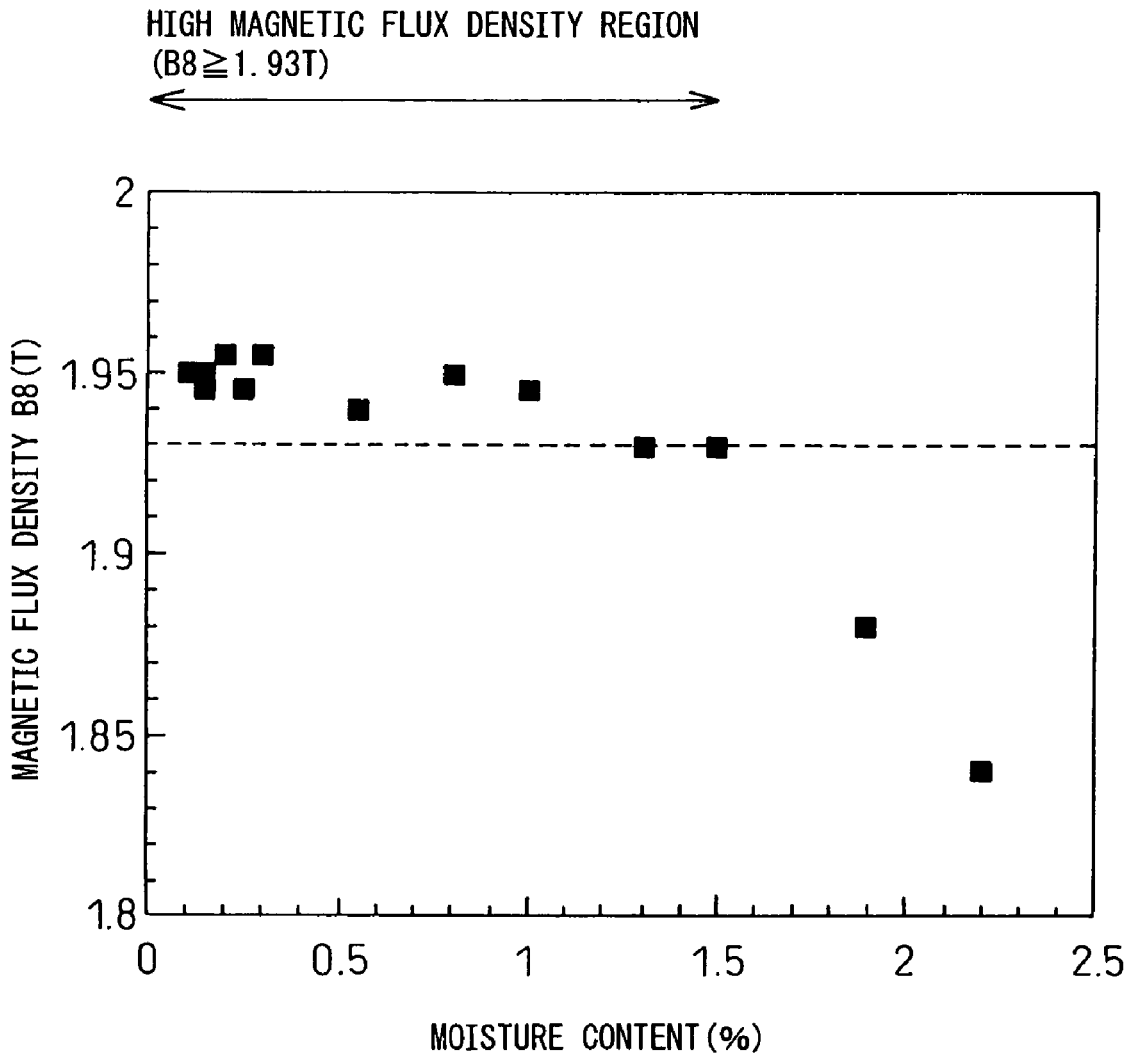
FIG. 1 shows the relationship between amount of moisture in an annealing separator consisting mainly of alumina after an aqueous slurry thereof has been applied and dried and the magnetic flux density (B8) of product.
Figure 2:
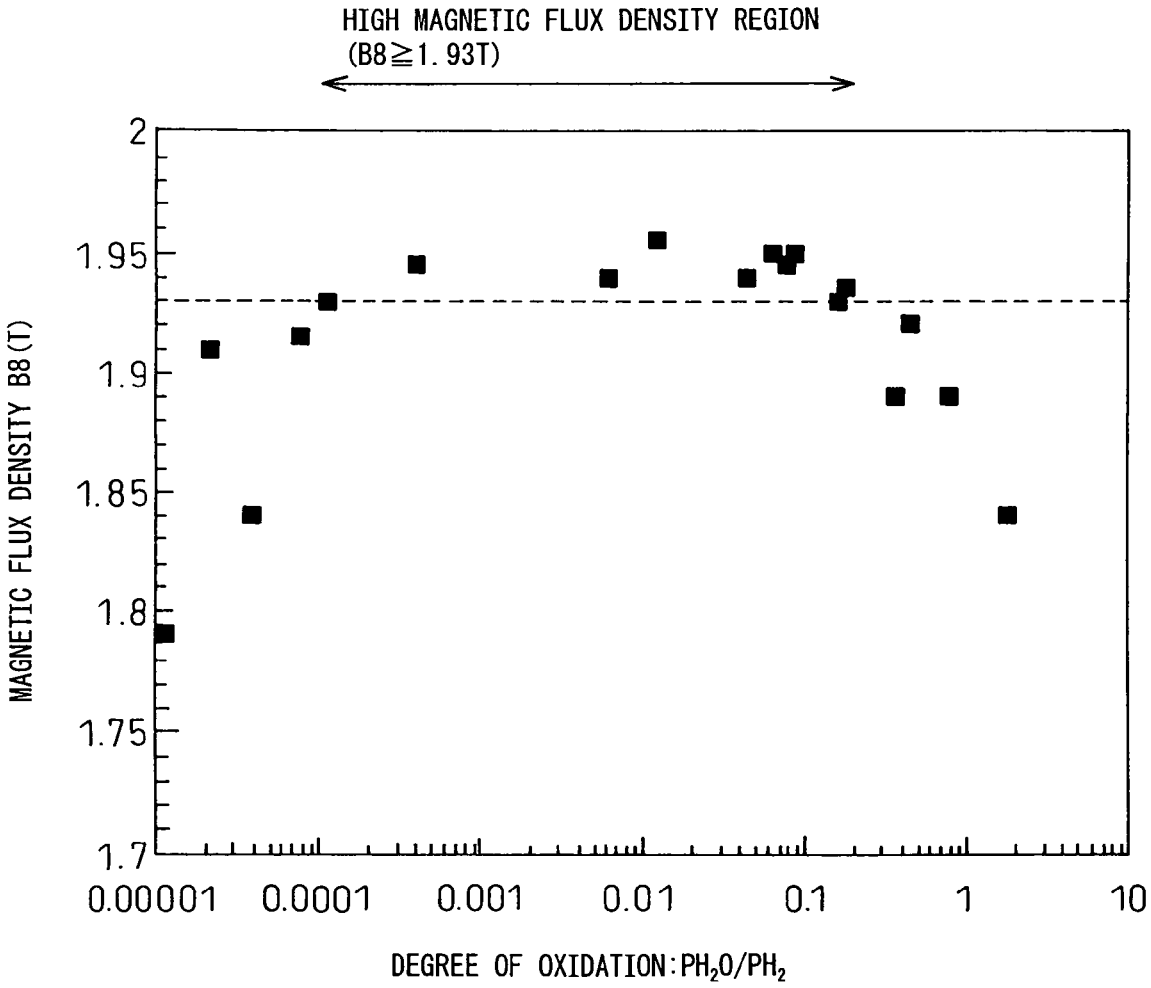
FIG. 2 shows the relationship between the degree of oxidation ($PH_2O/PH_2$) of the atmosphere gas in a finish-annealing and the magnetic flux density (B8) of product.
Figure 3:
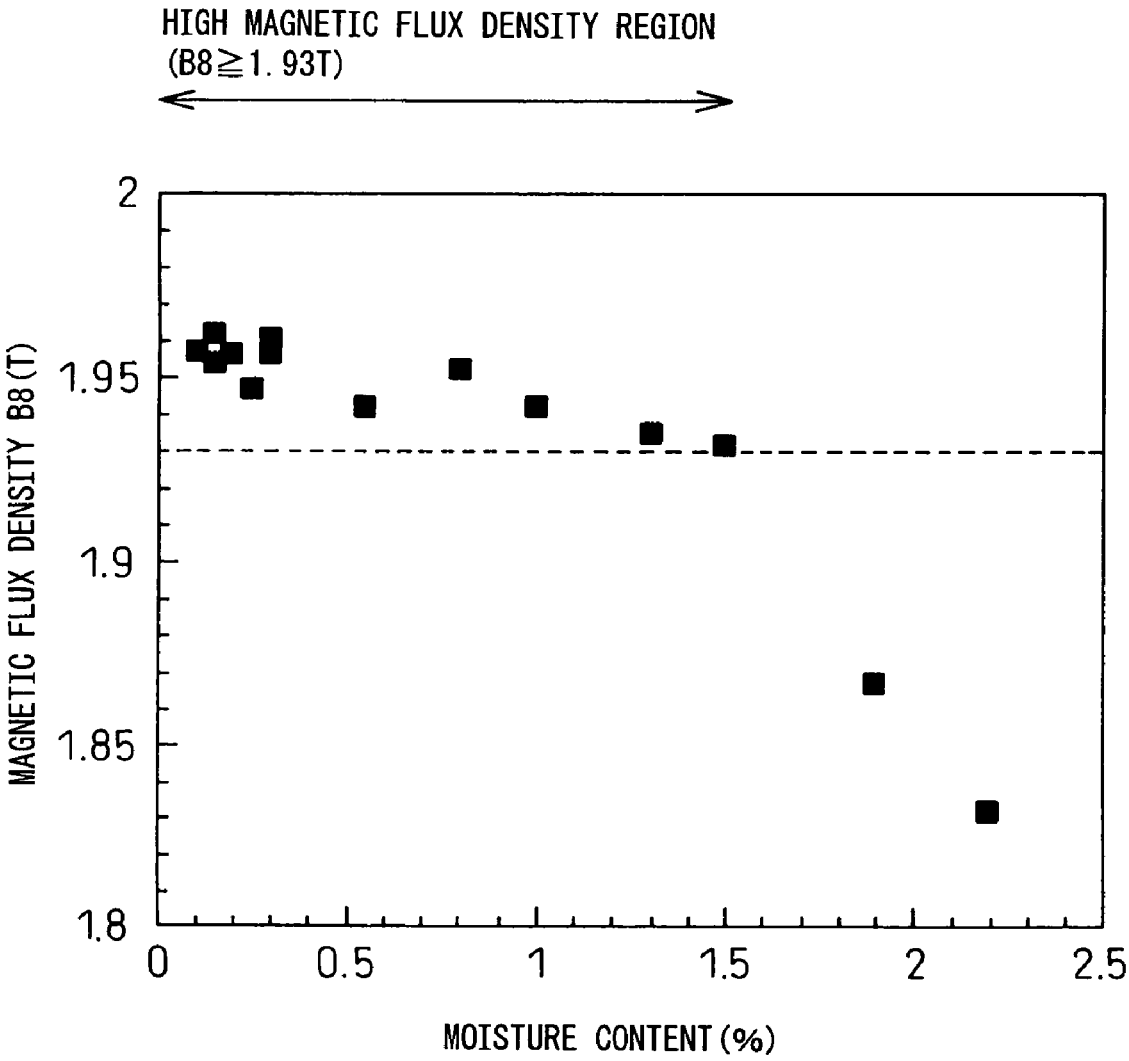
FIG. 3 shows the relationship between the amount of moisture carried in an experiment in which the dew point of the finish-annealing atmosphere not containing hydrogen is varied and the magnetic flux density (B8) of product.
Figure 4:
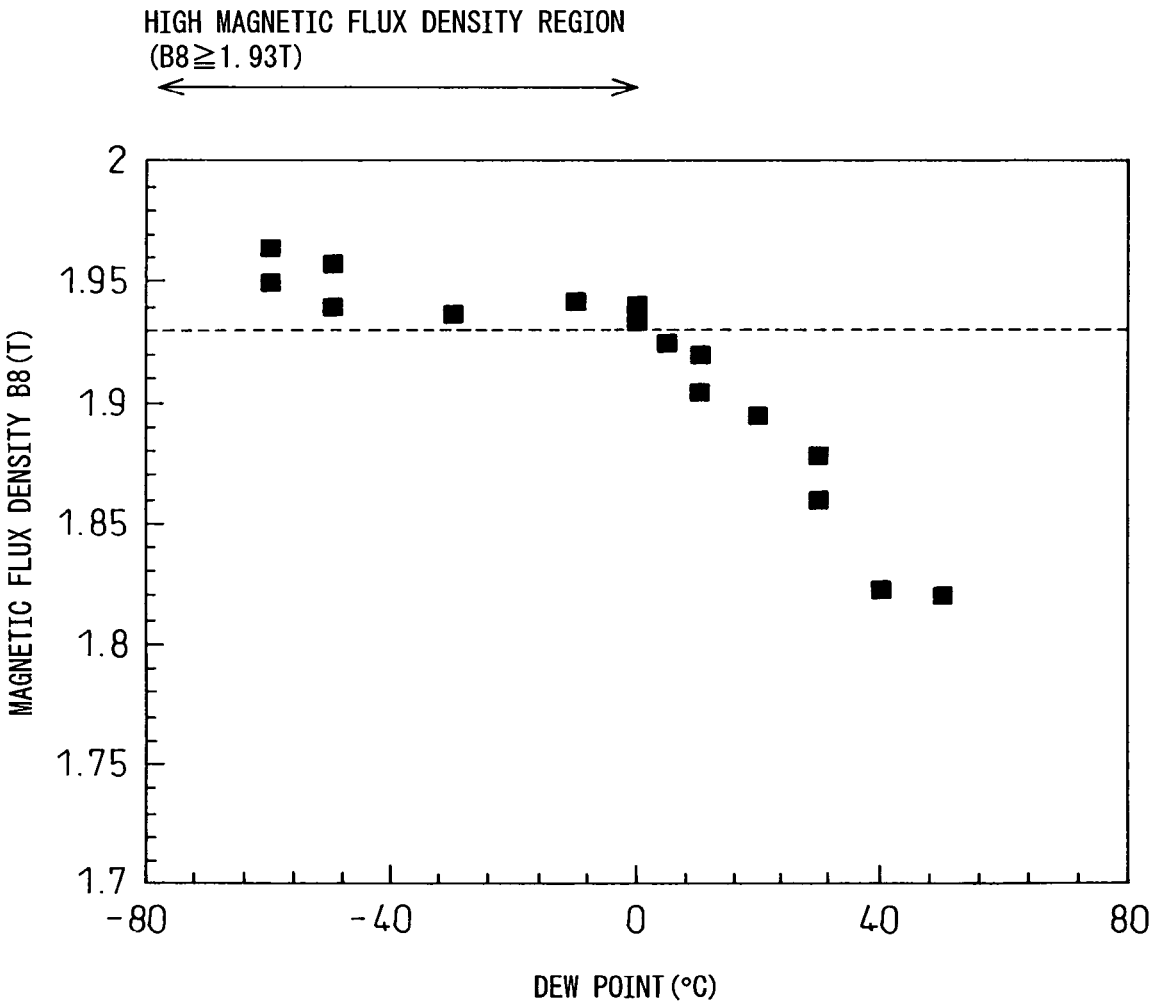
FIG. 4 shows the relationship between the dew point of the finish-annealing atmosphere not containing hydrogen and the magnetic flux density (B8) of product.

Preferred embodiments of the present invention are described below.

Methods for manufacturing products with high magnetic flux density (B8), such as one that heats slabs at low temperatures by using (Al, Si)N as the main inhibitor proposed by Komatsu et al. (as disclosed, for example, in Japanese Patent Publication No. 62-45285) and one that heats slabs at high temperatures by using AlN and MnS as the main inhibitor proposed by Taguchi, Sakakura etc. (as disclosed, for example, in Japanese Patent Publication No. 40-15644) can be used as the basic manufacturing method.

The chemical composition of silicon steel slabs is as described below, in which "%" means "mass %".

Si is an important element that increases electric resistance and reduces iron loss. When Si content exceeds 4.8%, the silicon steel becomes brittle and it is difficult to continue cold rolling as the material tends to crack. When Si content is lowered, $\alpha \rightarrow \gamma$ transformation occurs during finish-annealing, thereby impairing the orientation of crystal grains. Therefore, the lower limit of the Si content is set at 0.8% that does not substantially affect the orientation of crystal grains.

Acid-soluble Al is essential as an element to form an inhibitor of AlN or (Al, Si)N by combining with N. The content of acid-soluble Al is limited to between 0.012% and 0.05% where a high magnetic flux density is obtainable.

As N produces hollows, called blisters, in a steel sheet when the content thereof exceeds 0.01%, the upper limit is set at 0.01%.

Mn and S form MnS that serves as an inhibitor in the method to heat slabs at high temperatures proposed by Taguchi, Sakakura etc. Mn and S are respectively limited to between 0.030% and 0.15% and 0.01% and 0.05% where a high magnetic flux density is obtainable.

In the method to heat slabs at low temperatures by using (Al, Si)N as the main inhibitor proposed by Komatsu et al., it is preferred that the content of S is kept at 0.015% or below so that an adverse effect on magnetic properties can be avoided.

It is required to keep C content below 0.003% as residual C lowers the properties (iron loss) of product. If, however, the C content is lowered in the steelmaking process, coarse {100} elongated grains having an adverse effect on secondary recrystallization are formed in the crystalline structure of hot-rolled steel sheet. From the viewpoint of controlling precipitates and primary recrystallization texture, too, it is necessary to add some C in the steelmaking process.

It is therefore preferable to add C to 0.003% or more or, preferably, 0.02% or more so that $\alpha \rightarrow \gamma$ transformation occurs. The upper limit is set at 0.1% because a greater addition will increase the decarburization time without producing any improving effect on the crystalline structure and precipitates.

Sn and Sb contribute to the stable manufacture of products with high magnetic flux densities by segregating at the surface of steel sheet and controlling the decomposition of the inhibitor during finish-annealing. It is preferred that Sn and Sb of 0.03% to 0.15% are added. When the content is under 0.03%, the effect to control inhibitor decomposition decreases to nullify the magnetic flux density improvement. When the content exceeds 0.15%, nitridation in steel sheets becomes difficult and secondary recrystallization becomes unstable.

Cr is conducive to improving the oxidation layer formed by decarburized-annealing and forming glass coating. The presence of trace quantities of B, Bi, Cu, Se, Pb, Ti, Mo etc. does not conflict with the object of the present invention.

Molten steel of the composition described above is cast and hot-rolled into a sheet form by an ordinary casting process and a rolling process, or is continuously cast into strip. The hot-rolled sheet or strip is immediately, or after short annealing, cold-rolled.

Said annealing is carried out in a temperature range of 750° C. to 1200° C. and for a period of 30 seconds to 30 minutes. As this annealing enhances the magnetic properties of a product, whether to employ it or not can be decided by considering the desired level of product properties and cost.

Basically, cold-rolling is carried out to the final reduction rate of 80% or more, as disclosed in Japanese Patent Publication No. 40-15644.

The cold-rolled material is decarburized-annealed in a wet hydrogen atmosphere in order to remove the C contained in steel.

In order to achieve the mirror-like surface, it is essential to carry out this decarburized-annealing at a low enough degree of oxidation as to not form Fe-based oxides (such low grade oxides as $Fe_2SiO_4$ and FeO).

In a temperature range of 800° C. to 850° C. where decarburized-annealing is normally carried out, for example, formation of Fe-based oxides can be inhibited by controlling the degree of oxidation ($PH_2O/PH_2$) of the atmosphere to 0.15 or below. If the degree of oxidation is lowered too much, the decarburization rate will deteriorate. When these two factors are considered, the favorable degree of oxidation ($PH_2O/PH_2$) of the atmosphere in said temperature range is 0.01 to 0.15.

In the manufacturing method using (Al, Si)N as the main inhibitor (such as the one disclosed in Japanese Patent Publication No. 62-45285), a nitriding treatment is applied to the decarburized-annealed steel sheet. The method of the nitriding treatment is not limited to any specific one. It is implemented, for example, in an atmosphere, such as ammonia-containing gas, that has a nitriding capability. The amount of nitrogen increased by nitriding treatment is not lower than 0.005% or more, preferably the ratio of N to acid-soluble Al is not lower than 2/3.

After an aqueous slurry of an annealing separator, consisting mainly of alumina, is applied, the decarburized-annealed steel strip is dried and coiled. A key point of the invention is to control the amount of moisture carried in, after application and drying, to not more than 1.5%. Another key point is to inject a gas having a degree of oxidation ($PH_2O/PH_2$) of not lower than 0.0001 and not higher than 0.2 when the finish-annealing atmosphere contains hydrogen and an inert gas having a dew point of not higher than 0° C. when the finish-annealing atmosphere is an inert gas not containing hydrogen.

The amount of moisture carried in the annealing separator consisting mainly of alumina after application and drying of an aqueous slurry thereof is controlled by controlling the water temperature and stirring time in preparation of the aqueous slurry as well as the BET value and particle size of alumina.

A method to use a powder prepared by mixing a certain ratio of alumina and magnesia whose BET surface areas are controlled, a patent being applied for as per Japanese Patent Application No. 2001-220228, is effective for accelerating to provide mirror-like surface.

When there is insufficient adhesiveness with a steel sheet or a problem with settling of the slurry, a thickener can be used as required. Adding calcium oxide etc., to promote purification of sulfur in steel, does not impair the effect of the invention, as well.

The temperature zone in which the gas having a degree of oxidation ($PH_2O/PH_2$) of not lower than 0.0001 and not higher than 0.2 or an inert gas having a dew point of not higher than 0° C. is injected during finish-annealing is between 600° C. at which oxidation and reduction of the surface oxide layer substantially occurs and 1100° C. at which secondary recrystallization is almost complete. The control of the gas should be done at least within this temperature range.

Here, an inert gas means a gas having low reactivity with steel sheet such as N, Ar and other noble gases (belonging to the O group of the Periodic Table).

The layered decarburized-annealed steel sheets are finish-annealed to accomplish secondary recrystallization and purification of nitrides and/or sulfides. Implementation of secondary recrystallization in a given temperature zone by maintaining a certain temperature or controlling the heating rate, as disclosed in Japanese Unexamined Patent Publication (Kokai) No. 2-258929, is effective for increasing the magnetic flux density (B8) of product.

In order to purify nitrides and reduce the surface oxide layer, the steel sheet is annealed in 100% hydrogen at a temperature not lower than 1100° C. after completion of secondary recrystallization. It is preferred that the atmosphere gas has a lower dew point.

After finish-annealing is complete, tension coating is applied to the surface and laser irradiation or other magnetic domain fragmentation treatment is applied as required.

Examples of the present invention are described below.

EXAMPLE 1

A slab of silicon steel comprising Si of 3.3 mass %, Mn of 0.1 mass %, C of 0.06 mass %, S of 0.007 mass %, acid-soluble Al of 0.03 mass %, N of 0.008 mass % and Sn of 0.05 mass %, with the remainder substantially comprising Fe and unavoidable impurities, was heated to 1150° C. and hot-rolled to 2.3 mm thick hot-rolled strip. The hot-rolled strip was then annealed at 1120° C. for 2 minutes and cold-rolled to a final thickness of 0.22 mm.

The cold-rolled strip was decarburized-annealed for 2 minutes by heating to 830° C. at a rate of 40° C./second in a mixed gas of nitrogen and hydrogen whose degree of oxidation ($PH_2O/PH_2$) was adjusted to 0.1. Then, the strip was annealed in ammonia and the inhibitor was strengthened by increasing nitrogen content to 0.025%.

An aqueous slurry of an annealing separator consisting mainly of alumina was applied on the surface of the strip and dried. The amount of moisture carried in after application and drying was 0.3%.

Finish-annealing was carried out for 20 hours by heating to 1200° C. in a mixed gas of nitrogen and hydrogen described in (1) to (5) below and changing the mixed gas to hydrogen after the temperature reached 1200° C.

(1) A gas having a degree of oxidation of 0.061 (from room temperature to 1200° C.)

(2) A gas having a degree of oxidation of 0.000014 (from room temperature to 600° C.)—atmosphere gas having a degree of oxidation of 0.061 (600° C. to 1200° C.)

(3) A gas having a degree of oxidation of 0.000014 (from room temperature to 600° C.)—atmosphere gas having a degree of oxidation of 0.061 (600° C. to 1100° C.)—atmosphere gas having a degree of oxidation of 0.000014 (1100° C. to 1200° C.)

(4) A gas having a degree of oxidation of 0.061 (from room temperature to 600° C.)—atmosphere gas having a degree of oxidation of 0.000014 (600° C. to 1200° C.)

(5) A gas having a degree of oxidation of 0.000014 (from room temperature to 1200° C.)

After applying tension coating, the magnetic domains of the specimens prepared as described above were finely divided by laser irradiation. Table 1 shows the magnetic properties of the obtained products.

TABLE 1

| Finish-annealing condition | Magnetic flux density B8(T) | Iron loss W17/50(W/kg) | Remarks |
|---|---|---|---|
| (1) | 1.946 | 0.66 | Example of the invention |
| (2) | 1.940 | 0.67 | Example of the invention |

TABLE 1-continued

| Finish-annealing condition | Magnetic flux density B8(T) | Iron loss W17/50(W/kg) | Remarks |
|---|---|---|---|
| (3) | 1.953 | 0.64 | Example of the invention |
| (4) | 1.827 | — | Example for comparison |
| (5) | 1.788 | — | Example for comparison |

EXAMPLE 2

An aqueous slurry of an annealing separator prepared by mixing alumina having a BET specific surface area of 23.1 $m^2/g$ and magnesia having a BET specific surface area of 2.4 $m^2/g$ at a ratio of 8:2 was applied on the same decarburized-annealed specimens as those described in Example 1.

The amount of moisture carried in the annealing separator consisting mainly of alumina after application and drying of the aqueous slurry thereof was varied depending on the preparation conditions (such as water temperature and stirring time) of the aqueous slurries.

The obtained specimens were layered and finish-annealed. Finish-annealing was carried out for 20 hours by first heating, in a mixed gas of nitrogen and hydrogen having a degree of oxidation of 0.00011, to 1200° C. at a rate of 10° C./hour and then changing the mixed gas to hydrogen having a degree of oxidation of 0.000011.

After applying tension coating, the magnetic domains of the specimens prepared as described above were finely divided by laser irradiation. Table 2 shows the magnetic properties of the obtained products.

TABLE 2

| Amount of moisture carried in annealing separator after application and drying (%) | Magnetic flux density B8(T) | Iron loss W17/50(W/kg) | Remarks |
|---|---|---|---|
| 0.6 | 1.953 | 0.64 | Example of the invention |
| 1.2 | 1.949 | 0.65 | Example of the invention |
| 1.9 | 1.873 | 0.93 | Example for comparison |

EXAMPLE 3

The specimens with the amount of moisture in the annealing separator after application and drying was controlled to 0.6% in Example 2 were finish-annealed. Finish-annealing was carried out for 20 hours by first heating in a mixed gas of nitrogen and hydrogen having a degree of oxidation of 0.00011 to 1000° C. at a rate of 10° C./hour and then to 1200° C. at a rate of 5° C./hour in the same atmosphere gas, and changing the mixed gas to hydrogen having a degree of oxidation of 0.000011.

After applying tension coating, the magnetic domains of the specimens prepared as described above were finely divided by laser irradiation. Table 3 shows the magnetic properties of the obtained products.

TABLE 3

| Amount of moisture carried in annealing separator after application and drying (%) | Magnetic flux density B8(T) | Iron loss W17/50(W/kg) | Remarks |
|---|---|---|---|
| 0.6 | 1.962 | 0.61 | Example of the invention |

EXAMPLE 4

A slab of silicon steel comprising Si of 3.3 mass %, Mn of 0.1 mass %, C of 0.06 mass %, S of 0.007 mass %, acid-soluble Al of 0.03 mass %, N of 0.008 mass %, with the remainder substantially comprising Fe and unavoidable impurities, and the same slabs to which Sn of 0.05 mass % and 0.08 mass % were added were heated to 1150° C. and hot-rolled to 2.3 mm thick hot-rolled strip. The hot-rolled strips were then annealed at 1120° C. for 2 minutes and cold-rolled to a final thickness of 0.22 mm.

The cold-rolled strips were decarburized-annealed for 2 minutes by heating to 830° C. at a rate of 40° C./second in a mixed gas of nitrogen and hydrogen whose degree of oxidation ($PH_2O/PH_2$) was adjusted to 0.1. Then, the strips were annealed in ammonia and the inhibitor was strengthened by increasing nitrogen content to 0.026% to 0.029%.

An aqueous slurry of an annealing separator consisting mainly of alumina was applied on the surface of the strips and dried. The amount of moisture carried in after application and drying was 0.3%. Finish-annealing was carried out for 20 hours by heating to 1200° C. in a mixed gas of nitrogen and hydrogen having a degree of oxidation of 0.061 and then changing the mixed gas to hydrogen.

After applying tension coating, the magnetic domains of the specimens prepared as described above were finely divided by laser irradiation. Table 4 shows the magnetic properties of the obtained products.

TABLE 4

| Sn content in steel (%) | Magnetic flux density B8(T) | Iron loss W17/50(W/kg) | Remarks |
|---|---|---|---|
| 0 | 1.939 | 0.68 | Example of the invention |
| 0.05 | 1.946 | 0.66 | Example of the invention |
| 0.08 | 1.943 | 0.66 | Example of the invention |

EXAMPLE 5

A slab of silicon steel comprising Si of 3.1 mass %, C of 0.07 mass %, acid-soluble Al of 0.028 mass %, N of 0.007 mass %, Mn of 0.08 mass %, S of 0.025 mass %, Cu of 0.1 mass % and Sn of 0.12 mass %, with the remainder substantially comprising Fe and unavoidable impurities, was heated to 1350° C. and hot-rolled to 2.3 mm thick hot-rolled strip.

The obtained hot-rolled strip was cold-rolled to a thickness of 1.5 mm and, after being annealed at 1120° C. for 2 minutes, then further down to 0.22 mm. The cold-rolled strip was decarburized-annealed for 2 minutes by heating to 830° C. at a rate of 100° C./second in a mixed gas of nitrogen and hydrogen whose degree of oxidation ($PH_2O/PH_2$) was adjusted to 0.1.

An aqueous slurry of an annealing separator consisting mainly of alumina was applied on the decarburized-annealed specimen. The amount of moisture carried in after application and drying was varied depending on the preparation conditions (such as water temperature and stirring time) of the aqueous slurry. The obtained specimens were layered and finish-annealed.

Finish-annealing was carried out for 20 hours by first heating in a mixed gas of nitrogen and hydrogen having a degree of oxidation of 0.00011 to 1200° C. at a rate of 10° C./hour and then changing the mixed gas to hydrogen having a degree of oxidation of 0.000011.

After applying tension coating, the magnetic domains of the specimens prepared as described above were finely divided by laser irradiation. Table 5 shows the magnetic properties of the obtained products.

TABLE 5

| Amount of moisture carried in annealing separator after application and drying (%) | Magnetic flux density B8(T) | Iron loss W17/50(W/kg) | Remarks |
|---|---|---|---|
| 0.2 | 1.956 | 0.66 | Example of the invention |
| 0.8 | 1.952 | 0.67 | Example of the invention |
| 1.6 | 1.834 | 0.96 | Example for comparison |

EXAMPLE 6

An aqueous slurry of an annealing separator prepared by mixing the same decarburized-annealed specimens as those described in Example 5.

An aqueous slurry of an annealing separator prepared by mixing alumina having a BET specific surface area of 23.1 $m^2/g$ and magnesia having a BET specific surface area of 2.4 $m^2/g$ at a ratio of 8:2 was applied on the same decarburized-annealed specimens as those described in Example 5.

The amount of moisture carried in the annealing separator consisting mainly of alumina after application and drying of the aqueous slurry thereof was varied depending on the preparation conditions (such as water temperature and stirring time) of the aqueous slurries.

The obtained specimens were layered and finish-annealed. Finish-annealing was carried out for 20 hours by first heating in a mixed gas of nitrogen and hydrogen having a degree of oxidation of 0.00011 to 1200° C. at a rate of 10° C./hour and then changing the mixed gas to hydrogen having a degree of oxidation of 0.000011.

After applying tension coating, the magnetic domains of the specimens prepared as described above were finely divided by laser irradiation. Table 6 shows the magnetic properties of the obtained products.

TABLE 6

| Amount of moisture carried in annealing separator after application and drying (%) | Magnetic flux density B8(T) | Iron loss W17/50(W/kg) | Remarks |
|---|---|---|---|
| 0.6 | 1.958 | 0.64 | Example of the invention |
| 1.2 | 1.953 | 0.65 | Example of the invention |
| 1.9 | 1.773 | — | Example for comparison |

EXAMPLE 7

A slab of silicon steel comprising Si of 3.3 mass %, Mn of 0.1 mass %, C of 0.06 mass %, S of 0.007 mass %, acid-soluble Al of 0.03 mass %, N of 0.008 mass % and Sn of 0.05 mass %, with the remainder substantially comprising Fe and unavoidable impurities, was heated to 1150° C. and hot-rolled to 2.3 mm thick hot-rolled strip. The hot-rolled strip was then annealed at 1120° C. for 2 minutes and cold-rolled to a final thickness of 0.22 mm.

The cold-rolled strip was decarburized-annealed for 2 minutes by heating to 830° C. at a rate of 40° C./second in a mixed gas of nitrogen and hydrogen whose degree of oxidation ($PH_2O/PH_2$) was adjusted to 0.1. Then, the strip was annealed in ammonia and the inhibitor was strengthened by increasing nitrogen content to 0.025%.

An aqueous slurry of an annealing separator consisting mainly of alumina was applied on the surface of the strip and dried. The amount of moisture carried in after application and drying was 0.3%.

Finish-annealing was carried out for 20 hours by heating to 1200° C. in nitrogen gases described below and changing the nitrogen gases to hydrogen gas after the temperature reached 1200° C.

(1) Nitrogen gas having a dew point of −50° C. (from room temperature to 1200° C.)

(2) Nitrogen gas having a dew point of 10° C. (from room temperature to 600° C.)—nitrogen gas having a dew point of −50° C. (from 600° C. to 1200° C.)

(3) Nitrogen gas having a dew point of −50° C. (from room temperature to 600° C.)—nitrogen gas having a dew point of 10° C. (from 600° C. to 1100° C.)—nitrogen gas having a dew point of −50° C. (from 1100° C. to 1200° C.)

(4) Nitrogen gas having a dew point of 10° C. (from room temperature to 1200° C.)

After applying tension coating, the magnetic domains of the specimens prepared as described above were finely divided by laser irradiation. Table 7 shows the magnetic properties of the obtained products.

TABLE 7

| Finish-annealing condition | Magnetic flux density B8(T) | Iron loss W17/50(W/kg) | Remarks |
|---|---|---|---|
| (1) | 1.952 | 0.65 | Example of the invention |
| (2) | 1.944 | 0.67 | Example of the invention |

TABLE 7-continued

| Finish-annealing condition | Magnetic flux density B8(T) | Iron loss W17/50(W/kg) | Remarks |
|---|---|---|---|
| (3) | 1.813 | 0.94 | Example for comparison |
| (4) | 1.733 | — | Example for comparison |

EXAMPLE 8

An aqueous slurry of an annealing separator prepared by mixing alumina having a BET specific surface area of 23.1 $m^2/g$ and magnesia having a BET specific surface area of 2.4 $m^2/g$ at a ratio of 8:2 was applied on the same decarburized-annealed specimens as those described in Example 7.

The amount of moisture carried in the annealing separator consisting mainly of alumina after application and drying of the aqueous slurry thereof was varied depending on the preparation conditions (such as water temperature and stirring time) of the aqueous slurries.

The obtained specimens were layered and finish-annealed. Finish-annealing was carried out for 20 hours by first heating in nitrogen having a dew point of −50° C. to 1200° C. at a rate of 10° C./hour and changing the nitrogen to hydrogen having a dew point of −60° C. (with a degree of oxidation of 0.000011) after the temperature reached 1200° C.

After applying tension coating, the magnetic domains of the specimens prepared as described above were finely divided by laser irradiation. Table 8 shows the magnetic properties of the obtained products.

TABLE 8

| Amount of moisture carried in annealing separator after application and drying (%) | Magnetic flux density B8(T) | Iron loss W17/50(W/kg) | Remarks |
|---|---|---|---|
| 0.6 | 1.957 | 0.62 | Example of the invention |
| 1.2 | 1.951 | 0.65 | Example of the invention |
| 1.9 | 1.823 | 0.96 | Example for comparison |

EXAMPLE 9

In Example 8, the specimen with the amount of moisture in the annealing separator after application and drying controlled to 0.6% was finish-annealed. Finish-annealing was carried out for 20 hours by first heating to 1000° C. at a rate of 10° C./hour in a mixed gas consisting of 50% nitrogen and 50% argon having and having a dew point of −50° C., then to 1200° C. at a rate of 5° C./hour in the same gas and changing the mixed gas to hydrogen having a degree of oxidation of 0.000011.

After applying tension coating, the magnetic domains of the specimens prepared as described above were finely divided by laser irradiation. Table 9 shows the magnetic properties of the obtained products.

TABLE 9

| Amount of moisture carried in annealing separator after application and drying (%) | Magnetic flux density B8(T) | Iron loss W17/50(W/kg) | Remarks |
|---|---|---|---|
| 0.6 | 1.955 | 0.64 | Example of the invention |

EXAMPLE 10

A slab of silicon steel comprising Si of 3.3 mass %, Mn of 0.1 mass %, C of 0.06 mass %, S of 0.007 mass %, acid-soluble Al of 0.03 mass %, N of 0.008 mass %, with the remainder substantially comprising Fe and unavoidable impurities, and the same slabs to which Sn of 0.05 mass % and 0.08 mass % were added were heated to 1150° C. and hot-rolled to 2.3 mm thick hot-rolled strip. The hot-rolled strips were then annealed at 1120° C. for 2 minutes and cold-rolled to a final thickness of 0.22 mm.

The cold-rolled strips were decarburized-annealed for 2 minutes by heating to 830° C. at a rate of 40° C./second in a mixed gas of nitrogen and hydrogen whose degree of oxidation ($PH_2O/PH_2$) was adjusted to 0.1.

Then, the strips were annealed in ammonia and the inhibitor was strengthened by increasing nitrogen content to 0.026% to 0.029%.

An aqueous slurry of an annealing separator consisting mainly of alumina was applied on the surface of the strips and dried. The amount of moisture carried in after application and drying was 0.3%. Finish-annealing was carried out for 20 hours by heating to 1200° C. in nitrogen having a dew point of −50° C. and then changing the nitrogen to hydrogen.

After applying tension coating, the magnetic domains of the specimens prepared as described above were finely divided by laser irradiation. Table 10 shows the magnetic properties of the obtained products.

TABLE 10

| Sn content in steel (%) | Magnetic flux density B8(T) | Iron loss W17/50(W/kg) | Remarks |
|---|---|---|---|
| 0 | 1.942 | 0.68 | Example of the invention |
| 0.05 | 1.951 | 0.65 | Example of the invention |
| 0.08 | 1.945 | 0.66 | Example of the invention |

EXAMPLE 11

A slab of silicon steel comprising Si of 3.1 mass %, C of 0.07 mass %, acid-soluble Al of 0.028 mass %, N of 0.007 mass %, Mn of 0.08 mass %, S of 0.025 mass %, Cu of 0.1 mass % and Sn of 0.12 mass %, with the remainder substantially comprising Fe and unavoidable impurities, was heated to 1350° C. and hot-rolled to 2.3 mm thick hot-rolled strip.

The obtained hot-rolled strip was cold-rolled to a thickness of 1.5 mm and, after being annealed at 1120° C. for 2 minutes, then further to 0.22 mm. The cold-rolled strip was decarburized-annealed for 2 minutes by heating to 830° C.

at a rate of 100° C./second in a mixed gas of nitrogen and hydrogen whose degree of oxidation ($PH_2O/PH_2$) was adjusted to 0.1.

An aqueous slurry of an annealing separator consisting mainly of alumina was applied on the decarburized-annealed specimen. The amount of moisture carried in after application and drying was varied depending on the preparation conditions (such as water temperature and stirring time) of the aqueous slurry. The obtained specimens were layered and finish-annealed.

Finish-annealing was carried out for 20 hours by first heating in nitrogen having a dew point of −50° C. to 1200° C. at a rate of 10° C./hour and then changing the nitrogen to hydrogen having a degree of oxidation of 0.000011.

After applying tension coating, the magnetic domains of the specimens prepared as described above were finely divided by laser irradiation. Table 11 shows the magnetic properties of the obtained products.

TABLE 11

| Amount of moisture carried in annealing separator after application and drying (%) | Magnetic flux density B8(T) | Iron loss W17/50(W/kg) | Remarks |
|---|---|---|---|
| 0.2 | 1.962 | 0.65 | Example of the invention |
| 0.8 | 1.955 | 0.67 | Example of the invention |
| 1.6 | 1.792 | — | Example for comparison |

EXAMPLE 12

An aqueous slurry of an annealing separator prepared by mixing alumina having a BET specific surface area of 23.1 $m^2/g$ and magnesia having a BET specific surface area of 2.4 $m^2/g$ at a ratio of 8:2 was applied on the same decarburized-annealed specimens as those described in Example 11.

The amount of moisture carried in the annealing separator consisting mainly of alumina after application and drying of the aqueous slurry thereof was varied depending on the preparation conditions (such as water temperature and stirring time) of the aqueous slurries.

The obtained specimens were layered and finish-annealed. Finish-annealing was carried out for 20 hours by first heating in nitrogen having a dew point of −50° C. to 1200° C. at a rate of 10° C./hour and changing the nitrogen to hydrogen having a dew point of −60° C. (with a degree of oxidation of 0.000011) after the temperature reached 1200° C.

After applying tension coating, the magnetic domains of the specimens prepared as described above were finely divided by laser irradiation. Table 12 shows the magnetic properties of the obtained products.

TABLE 12

| Amount of moisture carried in annealing separator after application and drying (%) | Magnetic flux density B8(T) | Iron loss W17/50(W/kg) | Remarks |
|---|---|---|---|
| 0.6 | 1.960 | 0.63 | Example of the invention |

TABLE 12-continued

| Amount of moisture carried in annealing separator after application and drying (%) | Magnetic flux density B8(T) | Iron loss W17/50(W/kg) | Remarks |
|---|---|---|---|
| 1.2 | 1.952 | 0.65 | Example of the invention |
| 1.9 | 1.731 | — | Example for comparison |

INDUSTRIAL APPLICABILITY

The present invention permits stabilization of secondary recrystallization and mirror-finishing of the surface of silicon steel. Effective finishing of the surface leads to the manufacture of grain-oriented silicon steel sheets having lower iron losses than those of conventional products.

The invention claimed is:

1. A method for manufacturing grain-oriented silicon steel sheet with mirror-like surface having good iron loss properties, comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05% mass %, N of not more than 0.01 mass %, with the remainder substantially comprising Fe and unavoidable impurities after heating the slab at a temperature not higher than 1280° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, applying a nitriding treatment and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry to not more than 1.5% and, injecting an atmosphere gas having a degree of oxidation ($PH_2O/PH_2$) of not lower than 0.0001 and not higher than 0.2 during finish-annealing.

2. A method for manufacturing grain-oriented silicon steel sheet with mirror-like surface having good iron loss properties, comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, Mn of 0.03 mass % to 0.15 mass %, S of 0.01 mass % to 0.05 mass %, with the remainder substantially comprising Fe and unavoidable impurities after heating the slab at a temperature not lower than 1320° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry to not more than 1.5% and, injecting an atmosphere gas having a degree of oxidation ($PH_2O/PH_2$) of not lower than 0.0001 and not higher than 0.2 during finish-annealing.

3. The method for manufacturing grain-oriented silicon steel sheet with mirror-like surface having good iron loss properties according to claim 1 or 2, characterized by, injecting an atmosphere gas having a degree of oxidation ($PH_2O/PH_2$)of not lower than 0.0001 and not higher than 0.2 into a temperature zone of 600° C. to 1100° C. during said finish-annealing.

4. The method for manufacturing grain-oriented silicon steel sheet with mirror-like surface having good iron loss properties according to claim 1 or 2 characterized by, adding Sn or Sb or 0.03 mass % to 0.15 mass % to said steel.

5. A method for manufacturing grain-oriented silicon steel sheet with mirror-like surface having good iron loss properties comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, with the remainder substantially comprising Fe and unavoidable impurities after heating the slab at a temperature not higher than 1280° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, applying a nitriding treatment and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and injecting an inert gas having a dew point of not higher than 0° C. as the atmosphere gas during finish-annealing.

6. A method for manufacturing grain-oriented silicon steel sheet with mirror-like surface having good iron loss properties comprising the steps of:

preparing hot-rolled steel sheet by hot-rolling silicon steel slab comprising Si of 0.8 mass % to 4.8 mass %, C of 0.003 mass % to 0.1 mass %, acid-soluble Al of 0.012 mass % to 0.05 mass %, N of not more than 0.01 mass %, Mn of 0.03 mass % to 0.15 mass %, S of 0.01 mass % to 0.05 mass %, with the remainder substantially comprising Fe and unavoidable impurities after heating the slab at a temperature not lower than 1320° C., reducing the hot-rolled sheet, as rolled or after annealing, to a final sheet thickness by applying one or two or more cold rollings, with intermediate annealing interposed, forming an oxidized layer consisting mainly of silica on the surface of the cold-rolled steel sheet by implementing decarburized-annealing in an atmosphere gas of such degree of oxidation as to not form Fe-based oxides, and providing a mirror-like surface by finish-annealing the steel sheet applied by an annealing separator consisting mainly of alumina, the method for manufacturing grain-oriented silicon steel sheet with mirror-like surface being characterized by, controlling the amount of moisture carried in the annealing separator consisting mainly of alumina after application and drying of an aqueous slurry thereof to not more than 1.5% and injecting an inert gas having a dew point of not higher than 0° C. as the atmosphere gas during finish-annealing.

7. The method for manufacturing grain-oriented silicon steel sheet with mirror-like surface having good iron loss properties according to claim 5 or 6, characterized by, injecting inert gas having a dew point of not higher than 0° C. as the atmosphere gas into a temperature zone of 600° C. to 1100° C. during said finish-annealing.

8. The method for manufacturing grain-oriented silicon steel sheet with mirror-like surface having good iron loss properties according to claim 5 or 6 characterized by, adding Sn or Sb of 0.03 mass % to 0.15 mass % to said steel.

* * * * *